US008447217B2

(12) United States Patent
Mori

(10) Patent No.: US 8,447,217 B2
(45) Date of Patent: May 21, 2013

(54) IMAGE FORMING APPARATUS

(75) Inventor: Tomohide Mori, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 446 days.

(21) Appl. No.: 12/561,982

(22) Filed: Sep. 17, 2009

(65) Prior Publication Data

US 2010/0067925 A1 Mar. 18, 2010

(30) Foreign Application Priority Data

Sep. 18, 2008 (JP) ..... 2008-239533

(51) Int. Cl.
*G03G 15/22* (2006.01)

(52) U.S. Cl.
USPC ..... 399/306; 399/309; 399/314

(58) Field of Classification Search
USPC ..... 399/15, 44, 302, 306, 308, 314, 309
See application file for complete search history.

(56) References Cited

U.S. PATENT DOCUMENTS

| | | | | |
|---|---|---|---|---|
| 6,192,204 | B1 * | 2/2001 | Yagi et al. | 399/66 |
| 6,347,200 | B1 * | 2/2002 | Shigeta et al. | 399/66 |
| 2005/0220472 | A1 * | 10/2005 | Inukai | 399/66 |

FOREIGN PATENT DOCUMENTS

| | | |
|---|---|---|
| JP | 2-273771 | 11/1990 |
| JP | 9-15916 | 1/1997 |
| JP | 2002-156847 | 5/2002 |
| JP | 2003-98854 | 4/2003 |
| JP | 2005-128108 | 5/2005 |

OTHER PUBLICATIONS

Machine translation of JP 2003-098854.*

Japanese Notification of Reasons for Refusal mailed Jun. 8, 2010, directed to counterpart Japanese Application No. 2008-239533; 4 pages.

* cited by examiner

*Primary Examiner* — Walter L Lindsay, Jr.

*Assistant Examiner* — Barnabas Fekete

(74) *Attorney, Agent, or Firm* — Morrison & Foerster LLP

(57) ABSTRACT

A toner image can properly be transferred onto the second side of a paper sheet without being influenced by the toner image on the first side. There are provided a detection unit 20 for detecting overlap of the toner images on the first side and the second side of the paper sheet based on image data, and a transfer output adjustment unit 22 which changes a transfer voltage output for the second side in an area with the overlap of the toner images depending on the toner adhering amount of the first side.

9 Claims, 7 Drawing Sheets

*Fig. 8*

| | FIRST SIDE ADHERING AMOUNT (g / m$^2$) | | |
|---|---|---|---|
| TRANSFER VOLTAGE (V) | 0 | 4 | 7 |
| 1400 | × | × | × |
| 1600 | ○ | × | × |
| 1800 | ○ | ○ | × |
| 2000 | △ (TRANSFER RATE DECREASED) | ○ | ○ |

○ : APPROPRIATE VOLTAGE

IMAGE FORMING APPARATUS

This application is based on application No. 2008-239533 filed in Japan on Sep. 18, 2008, the contents of which are hereby incorporated by reference.

BACKGROUND OF THE INVENTION

The invention relates to an image forming apparatus such as monochrome or color electrophotographic copying machines, printers, facsimiles, and multi-functional machines having these functions.

In an image forming apparatus having an automatic double-sided copy function to form images on both sides of paper sheets, image formation on both the sides of the paper sheets is achieved by the steps of transferring a toner image formed on an image carrier such as photoconductor drums or intermediate transfer bodies onto the first side of a paper sheet in a transfer section, fixing the toner image thereon with a fixing device, feeding the paper sheet again after the paper sheet is reversed, transferring a next image formed on the image carrier onto the second side of the paper sheet, and fixing the image thereon again.

With such an automatic double-sided copy function, the paper sheet dries up and electric resistance increases at the instant when the toner image transferred onto the first side of the paper sheet passes the fixing device, and therefore when a toner image is transferred onto the second side with the same transfer output, failure of proper transfer sometimes occurs.

Proposed in Japanese Laid-open Patent Publication No. H2-273771 (JP2-273771A) is a method of changing the transfer conditions for transferring a next toner image onto the second side of the paper sheet after a toner image on the first side of the paper sheet passes the fixing device.

The resistance of paper sheets is changed not only by passing through the fixing device but also by the toner transferred onto the first side thereof. Accordingly, proposed in Japanese Laid-open Patent Publication No. H9-15916 (JP9-15916A) is a method of changing the transfer output of the second side based on a B/W ratio of the first side of the paper sheet.

In transferring images onto the second side of the paper sheet, the toner image on the first side exerts an influence most when the toner image with high adhering amount transferred in advance on the first side overlaps with the rear face of a portion of the second side onto which a toner image with high adhering amount is to be transferred. In the method of JP9-15916A, only the B/W ratio of the entire first side is detected, and therefore in the case where the entire B/W ratio is low while images of high toner adhering amount on the front and rear surfaces partially overlap with each other, transfer failure such as roughness is generated.

SUMMARY OF INVENTION

The inventor of the present invention studied the relation between the toner adhering amount of the first side and the resistance. As toner, polymer toner with an average particle diameter of 6.5 μm was used, and as paper sheets, CF paper by Konica Minolta (grammage of 80 g/m$^2$) was used. As a resistance measuring instrument, Hiresta by Mitsubishi Chemical was used to measure resistance in 10 seconds after 250V was applied with a HRS probe. FIG. 7 shows the result of the measurement, which indicates that the paper sheet with a toner image transferred onto the first side gains more resistance as the toner adhering amount on the first side increases. The resistance of the paper sheet is different by double figures between a portion of the paper sheet with no image on the first side and a portion of the paper sheet containing an image with the toner adhering amount of 6 g/m$^2$.

The inventor of the invention examined the transfer property when a blue solid image (7 g/m$^2$) was transferred onto the second side of the paper sheet which had a toner image on the first side, with the toner adhering amount and the transfer voltage of the first side being varied. FIG. 8 shows the result of the examination, which indicates that the appropriate voltage, which ensures the best transfer quality, is different by 400V between the case with no image on the first side and the case with an image with the toner adhering amount of 7 g/m$^2$. Accordingly, it was confirmed that when a transfer voltage was uniformly applied to the area, which contains an image with the toner adhering amount of 7 g/m$^2$ on the first side, so as to obtain an appropriate transfer output, the transfer output became excessive in the area with no image on the first side, resulting in decreased transfer rate and increased waste toner.

In view of the problems disclosed, an object of the present invention is to provide an image forming apparatus which can properly transfer a toner image onto the second side of a paper sheet without being influenced by a toner image on the first side of the paper sheet.

In order to accomplish the object, there is provided, in the first means, an image forming apparatus having a double-sided copy function including an image forming unit for forming a toner image on an image carrier based on image data, a transfer unit for bringing the toner image on the image carrier into contact with a paper sheet, and applying transfer voltage so as to transfer the toner image onto the paper sheet, and a fixing unit for fixing the toner image transferred onto the paper sheet, in which after a first toner image is transferred and fixed onto a first side of the paper sheet, a second toner image is transferred and fixed onto a second side of the paper sheet, the image forming apparatus further including a detection unit for detecting overlap of the toner images on the first side and the second side of the paper sheet based on image data, and a transfer output adjustment unit which changes a transfer voltage output for the second side in an area with the overlap of the toner images depending on a toner adhering amount of the first side.

In the second means, the detection unit for detecting the overlap of the toner images calculates average values of the toner adhering amounts in the respective image areas on each of the first side and the second side of the paper sheet based on image data, and determines whether or not any image area of the first side, which is located on a rear side of respective image areas of the second side, has toner of more than a specified amount so as to detect overlap of toner images.

In the third means, the transfer output adjustment unit determines a transfer voltage output in accordance with a toner adhering amount in an image area of the first side with a largest toner adhering amount among the respective image areas in a main scanning direction of a paper sheet.

In the fourth means, a temperature and humidity detection unit for detecting surrounding temperature and humidity is provided, in which a transfer voltage output is changed based on temperature and humidity detected by the temperature and humidity detection unit.

In the fifth means, a paper sheet resistance detection unit for detecting resistance of a paper sheet is provided, in which a transfer voltage output is changed based on resistance of the paper sheet detected by the paper sheet resistance detection unit.

In the sixth means, when a copy mode of the first side of a paper sheet is photograph mode, change of transfer voltage output by the transfer output adjustment unit is performed.

In the seventh means, when a copy mode of the first side of a paper sheet is monochrome mode, change of transfer voltage output by the transfer output adjustment unit is not performed.

According to the first means in the invention, as the transfer voltage output for the second side in an area with overlapped toner images is changed in accordance with the toner adhering amount of the first side, a toner image can properly be transferred onto the second side of the paper sheet without being influenced by the toner image on the first side, and therefore transfer failure such as roughness due to poor transfer output, roughness due to excessive output, and lowered transfer rate can be prevented, so that sufficient images can be formed. Since the transfer rate is high, the waste toner discarded without being transferred onto paper sheets can be decreased.

According to the second means in the invention, as average values of the toner adhering amounts in the respective image areas are calculated, and the overlap of toner images is detected depending on whether or not any image area on the first side has toner of more than a specified amount, the overlap of toner images can be detected promptly and reliably.

According to the third means in the invention, as the transfer voltage output is determined depending on the toner adhering amount in an image area of the first side which has a largest toner adhering amount among the respective image areas in a main scanning direction of a paper sheet, insufficient transfer does not occur in the main scanning direction of the paper sheet.

According to the fourth means in the invention, as the transfer voltage output is changed based on temperature and humidity, an appropriate transfer voltage corresponding to changes in resistance of the paper sheet due to temperature and humidity can be determined.

According to the fifth means in the invention, as the resistance of the paper sheet to be used is detected and the transfer voltage output is changed based on the detected resistance, it becomes possible to determine an appropriate transfer voltage according to the resistance of the paper sheet which varies with paper types, grammage and hygroscopic degrees.

According to the sixth means in the invention, as the transfer voltage output is changed in the photograph mode, the transfer quality of photographs is enhanced.

According to the seventh means in the invention, as the resistance of black toner is small in the monochrome mode, it is not necessary to change the transfer voltage output as in the case of the invention, and therefore control can be executed with ease.

BRIEF DESCRIPTION OF DRAWINGS

Further objects and advantages of the present invention will become clear from the following description taken in conjunction with the preferred embodiments thereof with reference to the accompanying drawings, in which:

FIG. 8 is a view showing the transfer property with the toner adhering amount of the first side of paper sheets and the transfer voltage varied.

DETAILED DESCRIPTION OF THE PREFERRED EMBODIMENTS

Description is now given of the embodiment of the invention with reference to the accompanying drawings.

Figure 1:
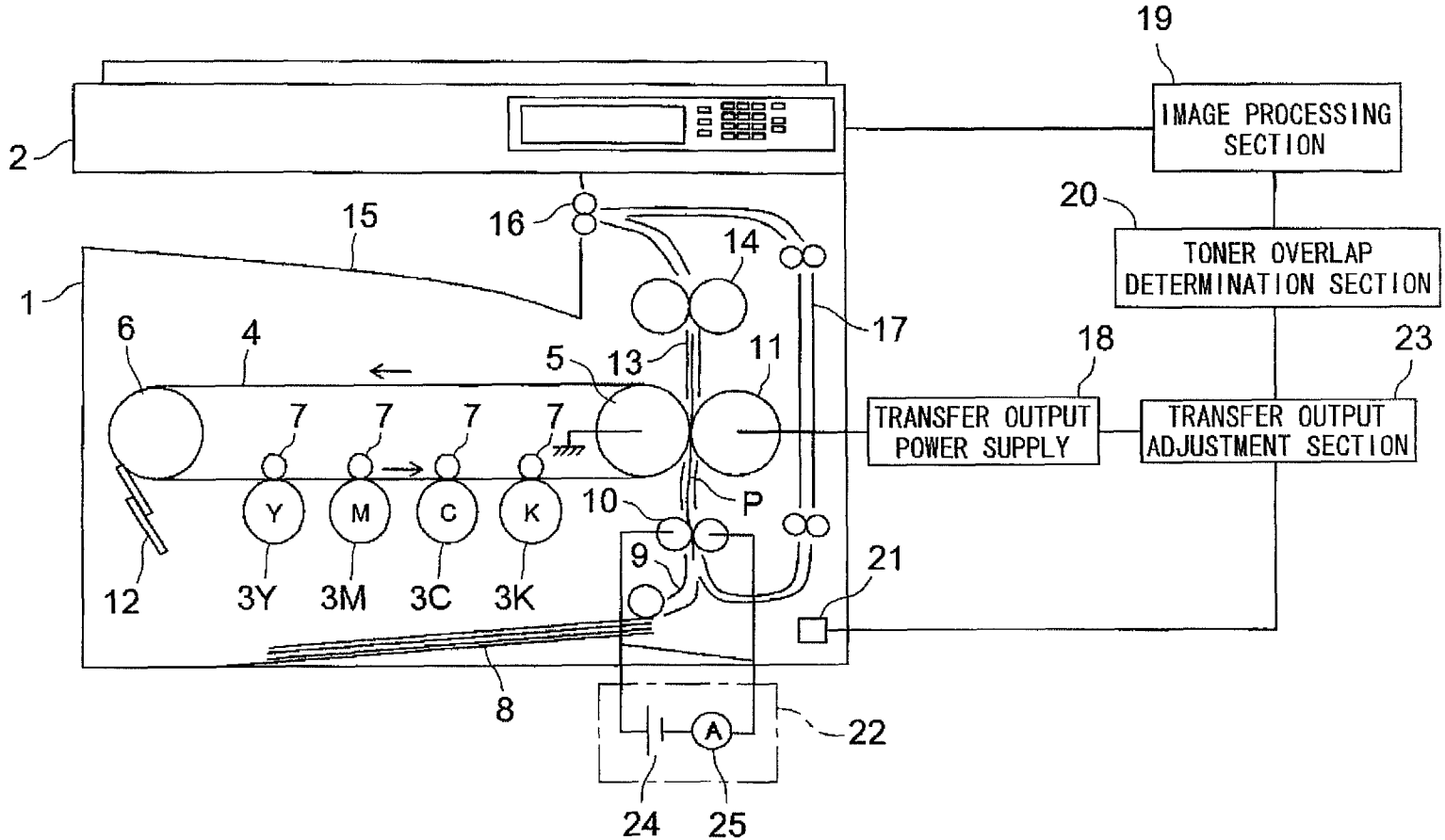
FIG. 1 is a simplified structure view of an image forming apparatus according to the invention.

FIG. 1 shows the simplified structure view of an image forming apparatus embodied in the invention. The image forming apparatus is composed of an image forming section 1 and an image reading section 2.

In the image forming section 1, image forming units 3Y, 3M, 3C and 3K for forming toner images of respective colors Y (yellow), M (magenta), C (cyan) and K (black) are placed along a straight line portion of an intermediate transfer belt 4.

The intermediate transfer belt 4, which is stretched over a driving roller 5 and a follower roller 6, can run in an arrow direction.

Inside the intermediate transfer belt 4, a primary transfer roller 7 is provided so as to face the respective image forming units 3Y and 3M, 3C and 3K across the intermediate transfer belt 4 so that the toner images on the image carriers are transferred onto the intermediate transfer belt 4 to form color toner images.

A secondary transfer roller 11 for transferring color toner images on the intermediate transfer belt 4 onto a paper sheet P fed from a feed section 8 through a feed path 9 and a timing roller 10 is placed so as to face the driving roller 5 of the intermediate transfer belt 4 across the intermediate transfer belt 4. A belt cleaning device 12 for removing the toner remaining on the intermediate transfer belt 4 is placed so as to face a follower roller 6 of the intermediate transfer belt 4 across the intermediate transfer belt 4.

A fixing device 14 for fixing the color toner images transferred by the secondary transfer roller 11 and a paper ejecting roller 16 for discharging the paper sheet P with the toner images fixed thereon to a paper ejection tray 15 are provided in a discharge path 13 on the downstream side from the secondary transfer roller 11 in the sheet conveying direction.

There is provided a conveying path 17 for double-sided copy which branches from the discharge path 13 on the upstream side of the paper ejecting roller 16 and goes to the upstream side of the timing roller 10.

A transfer output power supply 18 for applying transfer output voltage to the secondary transfer roller 11 is connected to the secondary transfer roller 11.

The image forming apparatus has an image processing section 19 for processing the image data from the image reading section 2, an image overlap determination section 20 for determining the overlap of images based on the image information from the image processing section 19, and a transfer output adjustment section 23 which obtains a transfer output based on the image overlap information from the image overlap determination section 20, the temperature and humidity information from a temperature and humidity sensor 21, and the paper sheet resistance from a paper sheet resistance detection device 22 and which adjusts the transfer output power supply 19 to be the obtained transfer output.

The temperature and humidity sensor 21, which is provided in an appropriate position inside the image forming apparatus, and more preferably in the vicinity of the feed section 8, measures the temperature and humidity inside the image forming apparatus. The paper sheet resistance detector 22 applies direct current power supply 24 to a pair of timing rollers 10, and measures the current which flows via the paper sheet P inserted in between the timing roller 10 with an ammeter 25.

Operation of the double-sided copy of the above-structured image forming apparatus will be described.

Toner images of the respective colors formed by each of the image forming units 3Y, 3M, 3C and 3K are transferred one by one onto the intermediate transfer belt 4 by the primary transfer roller 7 and are combined into a color toner image. The color toner image on the intermediate transfer belt 4 is conveyed in an arrow direction, and is transferred onto the first side of a paper sheet P by the secondary transfer roller 1. The paper sheet P with the color toner image transferred thereon passes the fixing device 14, where the color toner image is fixed. Next, the paper sheet P is switched back at the paper ejecting roller 16, travels through the conveying path 17 to the timing roller 10, goes into the feed path 9, and passes again the secondary transfer roller 11, where the next color toner image on the intermediate transfer belt 4 is transferred onto the second side of the paper sheet P, and after the color toner image is fixed by the fixing device 14, the paper sheet P is discharged into the paper ejection tray 15 by the paper ejecting roller 16.

Figure 2:
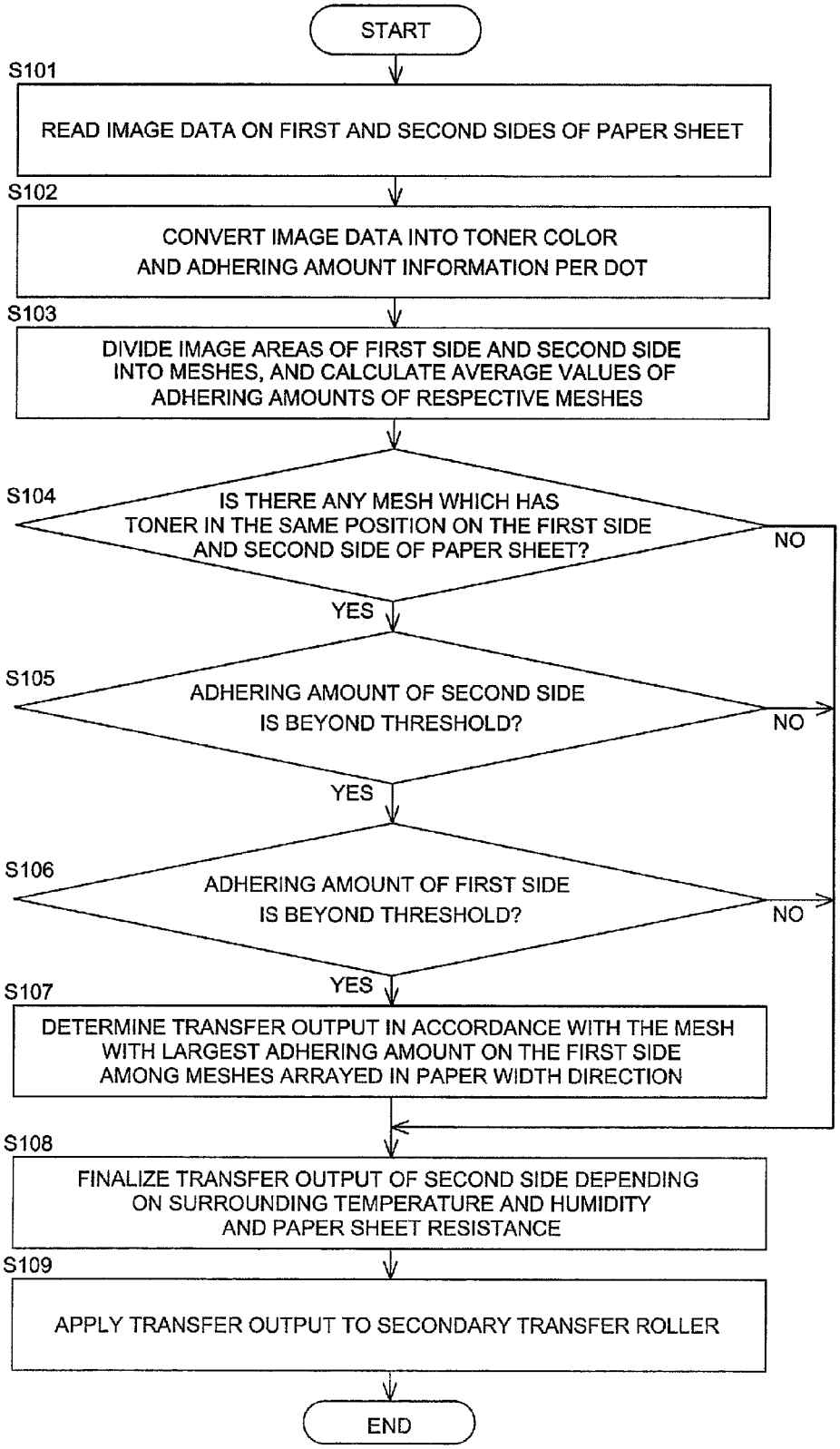
FIG. 2 is a flow chart showing control operation which determines a transfer output.

Control of the transfer output applied to the secondary transfer roller 11 by the image processing section 19, the image overlap determination section 20 and the transfer output adjustment section 23 will be described with reference to the flow chart shown in FIG. 2.

Once the image reading section 2 reads the first side and the second side of an original in the case of double sided-double sided copy, or the first page and the second page of an original in the case of one sided-double sided copy, the image processing section 19 reads the image data on the first side and the second side of the paper sheet, converts the data into a bitmap, and dissolves the bitmap into RGB signals in Step S101. In Step S102, the data is converted into colors of cyan (C), magenta (M), yellow (Y) and black (k), and into the toner adhering amounts thereof per pixel. In Step S103, respective image areas on the first side and the second side of the paper sheet are divided into meshes, and an average value of the toner adhering amounts in the respective meshes is calculated.

The information on paper size is preset by the user before printing. Therefore, in the image processing section 19, the position and the density of a toner image formed on the paper sheet can be obtained from the density information and the paper size information for every pixel.

In Step S104, the image overlap determination section 20 determines whether or not any mesh containing toner is present at the same position on the first side and the second side of the paper sheet (i.e., whether or not toner overlap is present). With a resolution of 600 dpi, the size of the mesh for determining the overlap of images is 100 dots square. If there is an overlap, it is determined whether or not the toner adhering amount on the second side of the paper sheet is beyond a predetermined threshold (e.g., 4 g/m$^2$) in Step S104. If it is beyond the threshold, then it is determined whether or not the toner adhering amount on the first side of the paper sheet is beyond a predetermined threshold (e.g., 4 g/m$^2$) in Step S105. If it is beyond the threshold, then the transfer output is determined in accordance with the mesh with the largest toner adhering amount on the first side among the meshes in the width direction of the paper sheet (vertical direction with respect to the conveying direction) in Step S106.

Figure 3:
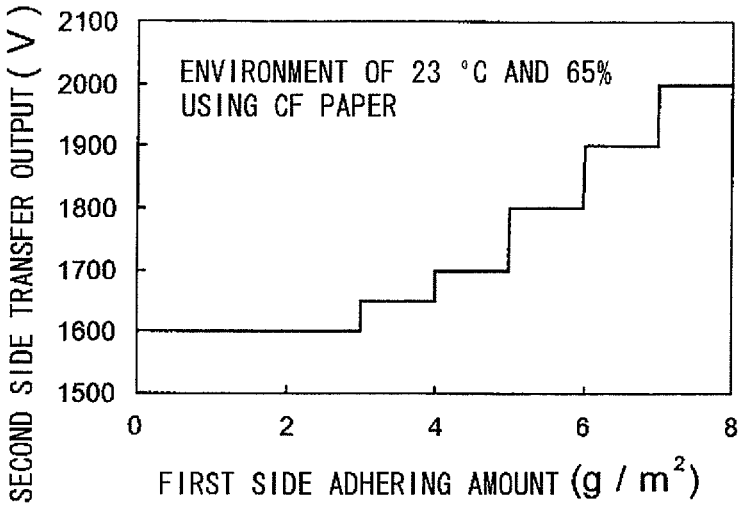
FIG. 3 is a view showing the relation between the toner adhering amounts of the first side and the transfer outputs of the second side.

There is an appropriate transfer output value which ensures generation of the most sufficient images. If the transfer output is smaller than the appropriate value, roughness is generated, whereas if the transfer output is larger, roughness and transfer rate decrease occur. The appropriate transfer output of the second side is defined as the voltage which allows a blue solid image (7 g/m$^2$) to be sufficiently transferred when there is no image on the first side. FIG. 3 shows appropriate transfer outputs of the second side against the toner adhering amounts of the first side with temperature of 23° C. and humidity of 65%.

If there is no overlap of toner in the Step S104, the toner adhering amount of the first side is below the predetermined threshold in Step S105, and the toner adhering amount of the second side is below the predetermined threshold in Step S106, then the procedure proceeds to Step S108.

In Step S108, the transfer output of the second side of the paper sheet is finalized based on the surrounding temperature and humidity from the temperature and humidity sensor 21 and the paper sheet resistance from the paper sheet resistance detector 22.

Figure 4:
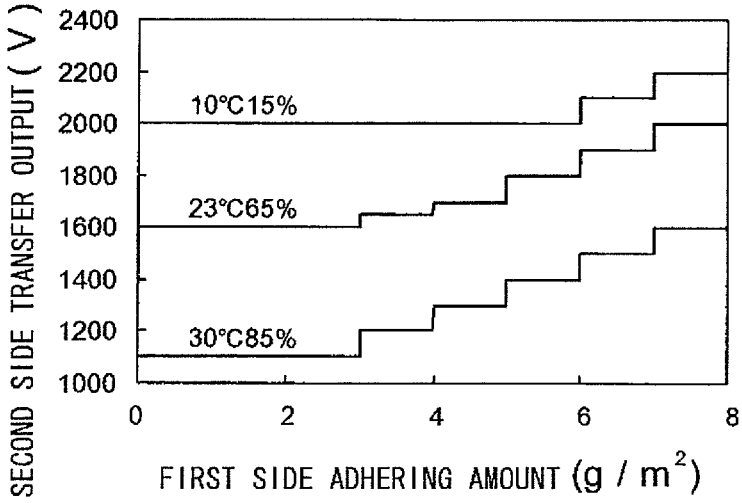
FIG. 4 is a view showing the relation between the toner adhering amounts of the first side and the transfer outputs of the second side in an environment with various temperature and humidity.

When the resistance of the paper sheet is low, the transfer property of the second side is influenced by the resistance of the toner of the toner image formed on the first side. When the resistance of the paper sheet is high, the transfer property of the second side is influenced more by the resistance of the paper sheet than by the resistance of the toner of the toner image formed on the first side. Since the resistance of paper is generally lowered by moisture absorption, the resistance of the paper sheets used by the image forming apparatus is changed by the surrounding temperature and humidity environment. The moisture of the paper sheet evaporates to some extent when the toner image is transferred onto the first side and then the paper sheet passes the fixing device 14, though the moisture is not dried up completely thereby. Accordingly, the above-mentioned temperature and humidity sensor 21 detects the temperature and humidity inside the image forming apparatus, and the transfer output of the second side is finalized depending on the detected temperature, the detected humidity and the toner adhering amount of the first side. FIG. 4 shows appropriate transfer outputs of the second side against the toner adhering amounts of the first side with the temperature of 10° C., the humidity of 15%, the temperature of 23° C., the humidity of 65%, the temperature of 30° C., and the humidity of 85%.

Since the resistance of paper varies by paper types, grammage, moisture absorption degrees and the like, the resistance of the paper sheet P during conveyance may be detected with the above-mentioned paper sheet resistance detector 22 using the timing roller 10 of the image forming apparatus, and the transfer output of the second side with respect to the toner adhering amount of the first side may be finalized depending on the detected resistance.

Finally, the transfer output is outputted to the transfer output power supply 18 in Step S107. As a result, the proper transfer output is applied to the secondary transfer roller 11.

Figure 5:
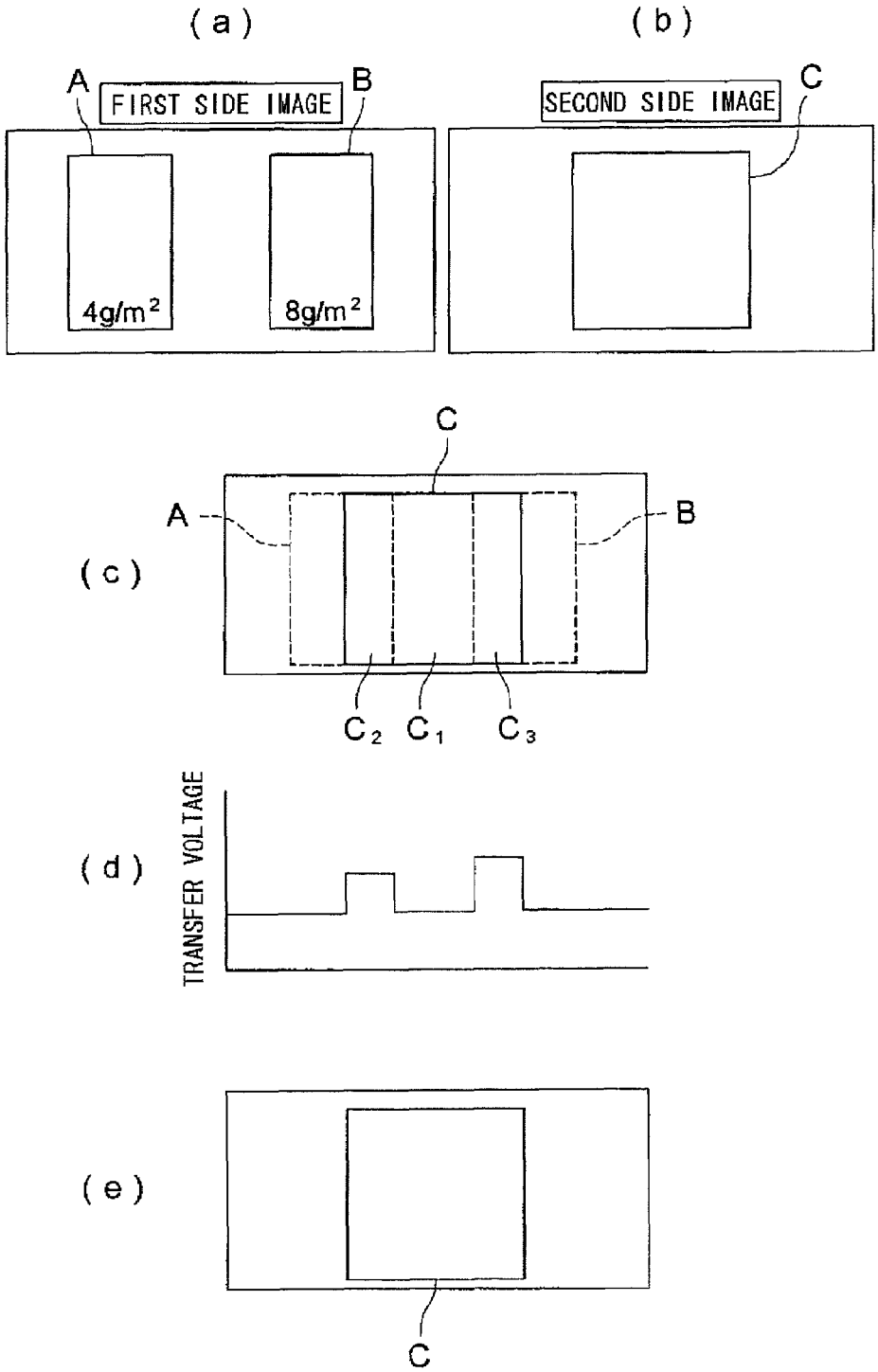
FIG. 5 is a view visually showing an example of the transfer output control of the invention.

FIG. 5 shows an image of the above-mentioned transfer output control, in which the toner adhering amount varies in a sub-scanning direction of the paper sheet, i.e., in the conveying direction. In the case where a light blue image A of 4 g/m$^2$ and a dark blue image B of 8 g/m$^2$ are formed at an interval on the first side as shown in FIG. 5A (showing corresponding positions seen from the second side), and a beige solid image C of 4 g/m$^2$ or more is printed on the second side so as to overlap with both the light blue image A and the dark blue image B of the first side as shown in FIG. 5B, irregular transfer occurs if the image of the second side is transferred with a uniform transfer output. That is, as shown in FIG. 5C, although the clear solid image of beige is transferred in a portion $C_1$ where no image is present on the first side, color irregularity occurs depending on the toner adhering amount in an area $C_2$ where the light blue image A is present on the first side and in an area $C_3$ where the dark blue image B is present. However, in the invention, the transfer output is determined depending on the toner adhering amount of each area on the first side as shown in FIG. 5D, so that the clear and uniform image C free from color irregularity is transferred onto the second side as shown in FIG. 5E.

Figure 6:
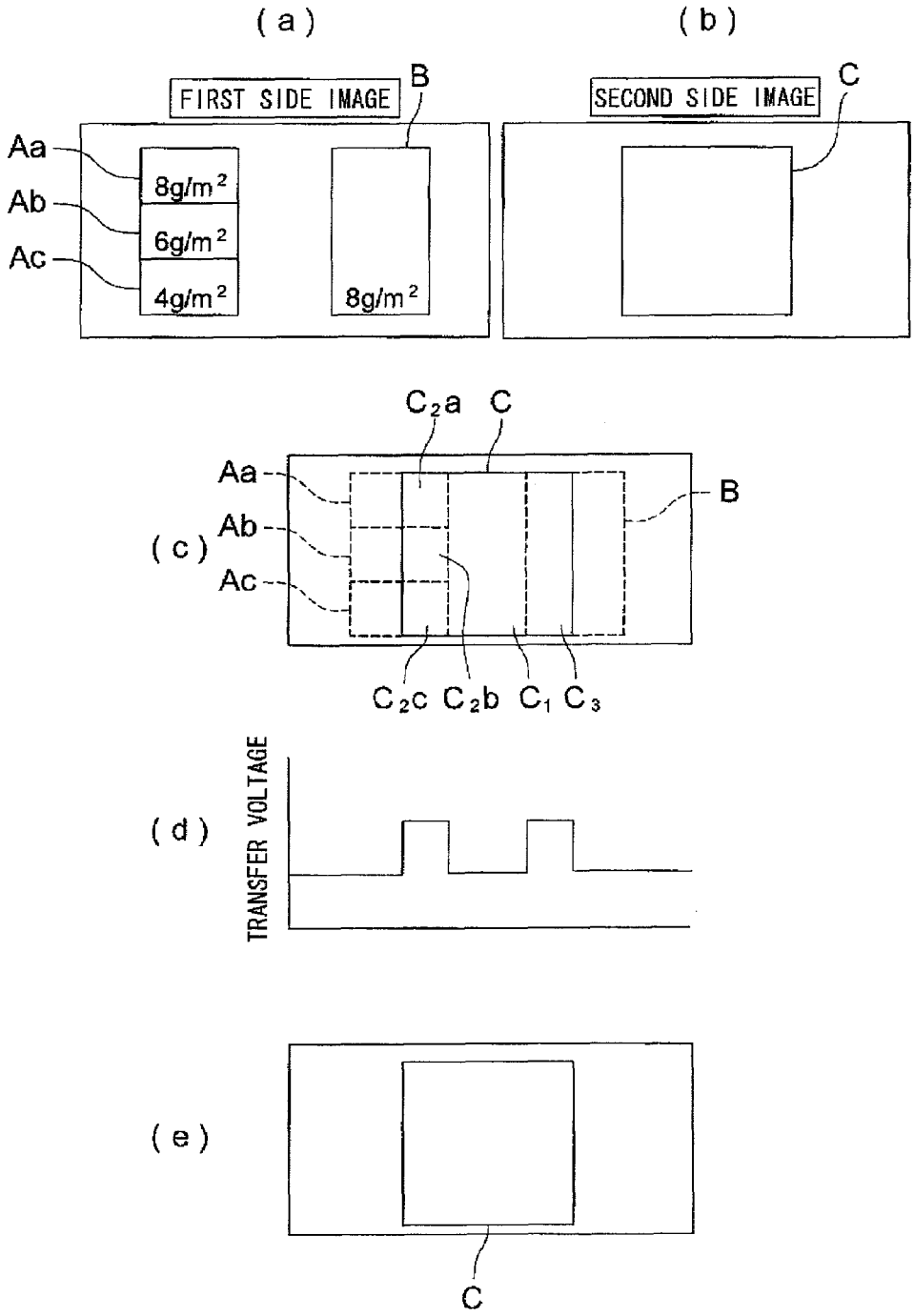
FIG. 6 is a view visually showing another example of the transfer output control of the invention.
Figure 7:
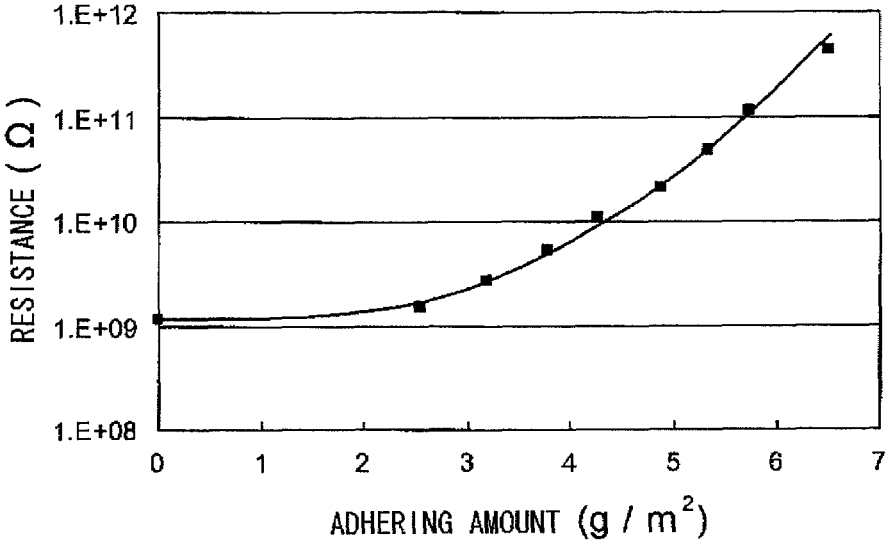
FIG. 7 is a view showing the relation between the toner adhering amount and the resistance.

FIG. 6 shows the case where images with different toner adhering amounts are present on the first side of the paper sheet in the direction vertical to the main scanning direction, i.e., the conveying direction. In the case where an image A including three areas Aa, Ab and Ac with different image densities, 8 g/m$^2$, 6 g/m$^2$ and 4 g/m$^2$, and an image B of 8 g/m$^2$ are formed at an interval in the main scanning direction on the first side (showing corresponding positions as seen from the second side) as shown in FIG. 6A, and an image C of 4 g/m$^2$ or more is printed on the second side so as to overlap with both the image A and the image B of the first side as shown in FIG. 6B, the transfer output is determined depending on the toner adhering amount of the area $C_{2a}$ which has the highest toner adhering amount in the area $C_2$ which contains the image A on the first side as shown in a FIG. 6D. As a result, the even and clear image C free from color irregularity is transferred onto the second side as shown in FIG. 6E.

The control of the above transfer output should preferably be performed in the photograph mode. This is because photographic images have larger toner adhering amounts than character images and therefore have a large influence onto the rear face, and also higher transfer quality is required as compared with character images.

When the first side is in the monochrome mode, it is not necessary to perform control of the transfer output. This is because carbon is used as a color material of black toner, so that the black toner is lower in resistance than color toner.

Although the present invention has been fully described by way of the examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

The invention claimed is:

1. An image forming apparatus having a double-sided print function, comprising:

an image forming unit for forming a toner image on an image carrier based on image data;

a transfer unit for bringing the toner image on the image carrier into contact with a paper sheet, and applying transfer voltage so as to transfer the toner image onto the paper sheet; and a fixing unit for fixing the toner image transferred onto the paper sheet, wherein after a first toner image is transferred and fixed onto a first side of the paper sheet, a second toner image is transferred and fixed onto a second side of the paper sheet, the image forming apparatus further comprising:

a detection unit to detect overlap of the toner images on the first side and the second side of the paper sheet based on image data with respect to each image area having a predetermined width in a sub-scanning direction; and a transfer output adjustment unit which changes a transfer voltage output for the second side in the image area with the overlap of the toner images detected with respect to each image area in one paper sheet in accordance with a toner adhering amount of the first side in the image area with the overlap of the toner images detected.

2. The image forming apparatus as in claim 1, comprising a temperature and humidity detection unit for detecting surrounding temperature and humidity, wherein a transfer voltage output is changed based on temperature and humidity detected by the temperature and humidity detection unit.

3. The image forming apparatus as in claim 1, comprising a paper sheet resistance detection unit for detecting resistance of a paper sheet, wherein a transfer voltage output is changed based on resistance of the paper sheet detected by the paper sheet resistance detection unit.

4. The image forming apparatus as in claim 1, wherein when a print mode is photograph mode, change of transfer voltage output by the transfer output adjustment unit is performed.

5. The image forming apparatus as in claim 1, wherein when a print mode is monochrome mode, change of transfer voltage output by the transfer output adjustment unit is not performed.

6. The image forming apparatus as in claim 1, wherein the transfer output adjustment unit changes the transfer voltage output so that the transfer voltage output for the second side in the image area becomes larger when the adhering amount of the first side in the image area is large.

7. The image forming apparatus as in claim 1, wherein the image area having the predetermined width in the sub-scanning direction comprises a mesh area having a predetermined width in a main-scanning direction, the apparatus further comprising:

a first calculating unit for calculating an average value of the toner adhering amounts in the respective mesh areas in the first side; and a second calculating unit for calculating an average value of the toner adhering amounts in the respective mesh areas in the second side;

wherein the detection unit to detect overlap of the toner images detects the overlap of the toner images on the first side and the second side with respect to each mesh area based on the average value of the toner adhering amounts in the first side and the average value of the toner adhering amounts in the second side in the mesh areas at the same position calculated by the first calculating unit and the second calculating unit; and wherein the transfer output adjustment unit changes the transfer voltage output for the second side in the image area including the mesh areas with the overlap of the toner images detected in accordance with the toner adhering amount of the first side in the mesh area with the most toner adhering amount in the first side among the mesh areas with the overlap of the toner images detected.

8. The image forming apparatus as in claim 7, further comprising:

a first determination unit to determine whether or not the average value of the toner adhering amounts in the second side in the mesh area with the overlap of the toner images detected is beyond a first predetermined value, wherein the transfer output adjustment unit changes the transfer voltage output for the second side in the image area when the first determination unit determines that the average value of the toner adhering amounts in the second side in the mesh area is beyond the first predetermined value.

9. The image forming apparatus as in claim 8, further comprising:

a second determination unit to determine whether or not the average value of the toner adhering amounts in the first side in the mesh area with the overlap of the toner images detected is beyond a second predetermined value, wherein the transfer output adjustment unit changes the transfer voltage output for the second side in the image area when the first determination unit determines that the average value of the toner adhering amounts in the second side in the mesh area is beyond the first predetermined value and the second determination unit determines that the average value of the toner adhering amounts in the first side in the mesh area is beyond the second predetermined value.

* * * * *